United States Patent [19]

Pleschiutschnigg et al.

[11] Patent Number: 4,928,747

[45] Date of Patent: May 29, 1990

[54] SIDE WALL GEOMETRY FOR MOLDS FOR CASTING OF THIN SLABS

[75] Inventors: Fritz-Peter Pleschiutschnigg, Duisburg; Gerd Moellers, Oberhausen; Hans-Georg Eberhardt, Duisburg; Werner Rahmfeld, Muelheim; Lothar Parschat, Ratingen; Hans-Juergen Ehrenberg, Duesseldorf, all of Fed. Rep. of Germany

[73] Assignee: Mannesmann AG, Duesseldorf, Fed. Rep. of Germany

[21] Appl. No.: 209,689

[22] Filed: Jun. 21, 1988

[30] Foreign Application Priority Data

Jul. 22, 1987 [DE] Fed. Rep. of Germany ..... 3724628

[51] Int. Cl.[5] ..... B22D 11/04

[52] U.S. Cl. ..... 164/418; 164/459

[58] Field of Search ..... 164/418, 459

[56] References Cited

FOREIGN PATENT DOCUMENTS

| | | | |
|---|---|---|---|
| 0227154 | 7/1987 | European Pat. Off. | 164/418 |
| 52-47525 | 4/1977 | Japan | 164/418 |
| 59-87957 | 5/1984 | Japan | 164/418 |
| 59-101259 | 6/1984 | Japan | 164/418 |
| 143215 | 5/1961 | U.S.S.R. | 164/418 |

*Primary Examiner*—Nicholas P. Godici
*Assistant Examiner*—J. Reed Batten, Jr.
*Attorney, Agent, or Firm*—Ralf H. Siegemund

[57] ABSTRACT

Seen against the direction of casting, the narrow width dimension of a mold is widened through appropriate surface contour, at least in the mold center, to facilitate charging of the mold whereby the lower portions of the longitudinal walls of the mold are essentially parallely curved while in the upper portion at least one of the walls tangentially merges into the pour-in portion of the mold.

6 Claims, 4 Drawing Sheets

SIDE WALL GEOMETRY FOR MOLDS FOR CASTING OF THIN SLABS

BACKGROUND OF THE INVENTION

The present invention relates to a mold for continuous casting a thin slab ingots, the mold is to include two wide (long) side walls facing each other across the relatively width of the mold, as well as two approximately parallel transverse walls.

The casting of ingots in a continuous fashion, the ingots being of the slab ingot type, requires a mold construction that is dictated by several contraints. A variety of construction types are known, but they can simply be classified into curved ones and straight ones. In the latter case, the walls run essential parallel, in the case of curved wall portions, they are essential concentrical. Very thin slab ingots, when made in thin fashion, require, as far as the mold construction is concerned, a large width-to-depth ratio. The introduction of the molten material into the world cavity poses difficulties in order to obtain a uniform charge in terms of level. This holds true for straight molds and curved molds pose even greater difficulties because the very fact that there is a curvature narrows the area into which the casting spout or pipe can be introduced.

In order to obviate the problem of charging molds for thin slab ingots, a proposal has been made in the journal "Stahl und Eisen"106-1986, pages 1255 and 1256, to provide the insertion or charge zone itself as a funnel shaped region. That works only, however, if the mold is generally straight. The casing spout is then matched through lateral flattenings to the overall cross-section. This funnel-shaped enlargement of the mold walls is, however, undersirable from the point of view of skin deformation of the casting in the mold. These deformations are known to occur, but in the past one had to put up with them, simply as a compromise, in order to control the charge process of the mold.

SUMMARY OF THE INVENTION

It is an object of the present invention to avoid the difficulties outlined above and to provide a mold for continuous casting of thin flat ingots, for example of the dimensional range from 40 to 90 millimeter by 400 to 200 millimeters, such that the skin deforms only to a very minimial extent within the mold, and under utilization of a casting spout which does find a maximum insertion and charge space within the mold.

Therefore, it is a specific object of the present invention to provide a new and improved mold for continuous casting of thin slab ingots with two wide or long sides that face each other across the mold cavity, and two small ones.

In accordance with the preferred embodiment of the present invention, it is suggested to provide the long or wide sides such that they are essentially curved in parallel (concentrical) in the lower part of the mold and establish a particular low mold section, while in the upper mold portion at least one of the wide walls merges over at least a portion, and recedes laterally from the other surface to provide local widening of the mold cavity. The mold walls, as seen in the opposite direction of the casting flow, change from a parallel-curved concentric configuration toward at least locally widening the mold cavity. Basically, one of these curved walls, or both, merges tangentially into a straight portion that enlarges and widens the charge cross-section of the upper mold part, at least over a portion of the width. Specifically, the transition point from curved to straight wall portion, as far as the concave wall curve is concerned, should be below the halfway mark of the height of the mold. The transition on the inside convex wall, as far as the mold curvature is concerned, and if occuring at all, should occur above the half height point or level. The mold cavity widening transitions could cover only a portion in the middle of the mold.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now to a detailed description of the drawings, FIG. 1 illustrates a mold for continuous casting 1 having a lower opening 1*a* being closer to the upper end of a guide structure 2 which is established by upper and lower roller tracks. Transport rollers 3 and 7 follow respectively in downstream direction, completing the transition for veering the casting 20 into the horizontal. The casting leaves the mold 1 in a not quite vertical direction and completion of horizontal transition is essentially established by the track and guide structure 2.

The mold 1 is fed from a tundish 4 under utilization of a casting spout and feed pipe 5 which extends from the bottom of the tundish 4 into the interior and cavity of the mold 1. A plug 6 serves to control the outflow of the molten material, such as steel, from the tundish 4 into the mold 1. FIG. 1 shows also rather generally a widening of the mold cavity in upper direction, being the direction opposite to casting.

FIG. 2 now shows a first example of the mold 1 as to details with emphasis on the features constituting the basic aspect of the invention. Only the long sides 8 and 9 are shown. The short sides are conventional. The walls 8 and 9 respectively have lower surface parts 8' and 9' which are concentric to each other. Surface portion 8' is concavely curved and constitutes the outer boundary of the mold cavity in terms of its overall curvatures. Surface portion 9' of the inner wall is analogously convexly curved and constitutes the inner mold cavity boundary accordingly.

Figure 1:
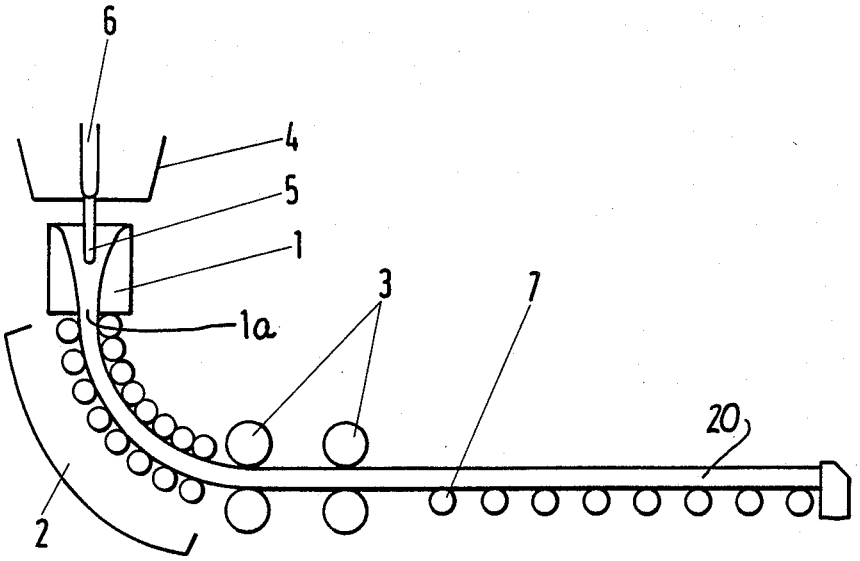
FIG. 1 is a schematic side view of a machine for continuous casting using a mold constructed in accordance with the preferred embodiment of the present invention for practicing the best mode thereof.

R1 constitutes a horizontal direction identifying the radius of curvature of convexly shaped mold surface 9'. This radius R1, moreover, is situated in a horizontal plane and can be deemed to define that plane, in a level in which it insects the curved mold surface mold surface 9' at right angles (angle 9-1). The same could be true for surface 8' except that below the horizontal R1 level, a transition point 10 is defined in which the curved mold surface 8' merges (as seen in direction opposite to casting) with a straight surface portion 8'' which is slanted accordingly, and thus extends horizontally, laterally, and outwardly to open up the upper mold cavity.

The mold surface wall 8'' is generally situated on the outside as far as the curving is concerned, and in up direction the curved part 8' merges tangentially into a portion 8'' which is (i) straight but also (ii) tends to enlarge the cross-section of the mold; the mold cavity thus widens in that surface 8'' recedes laterally and horizontally from 9'. The reference 10 introduced above specifically denotes the transition of the curved wall surface portion 8' to the straight wall portion 8''. As far as the concave wall surface 8' is concerned, the transition point 10 is indeed situated below the horizontal line R1.

As compared with either a curved mold being curved throughout the extension of the wall on one hand, or as compared with a mold which goes straight up from the horizontal line—the relocation of the transition point from curved to straight below the horizontal, namely to the point 10, causes the wall surface portion 8'' to have an upward slant. Reference 12 schematically denotes through hatching the gained mold space that has been gained.

Reference numeral 11 refers to an upper mold cavity portion having width 11' which would be established if both wall surfaces 8' and 9' were to merge in vertical planes right in the plane that contains R1 (9'' from 9'). Reference 13 denotes the augmentation of that mold cavity space in accordance with a first way of realizing the invention. Hence the mold could be bounded on the inside by the straight up wall surface 9''.

On the other hand, the convexly curved mold wall portions 9' continue and thereby establish an additional enlargement 13 of the mold cavity. The curvature does not have to be the same, but for reasons of practicality, it is. This means, then, that there is no transition at all into a straight wall portion. Thus the area and zones 12 and 13 together establish an enlargement of the cross-section area in the mold now available for changing the mold by means of a conventional, suitably configured and inserted discharge pipe. The situation is only slightly or not at all changed if one foregoes one or the other widening zone, 12 or 13 and instead has one wall surface straight up from the horizontal plane R1

Figure 2:
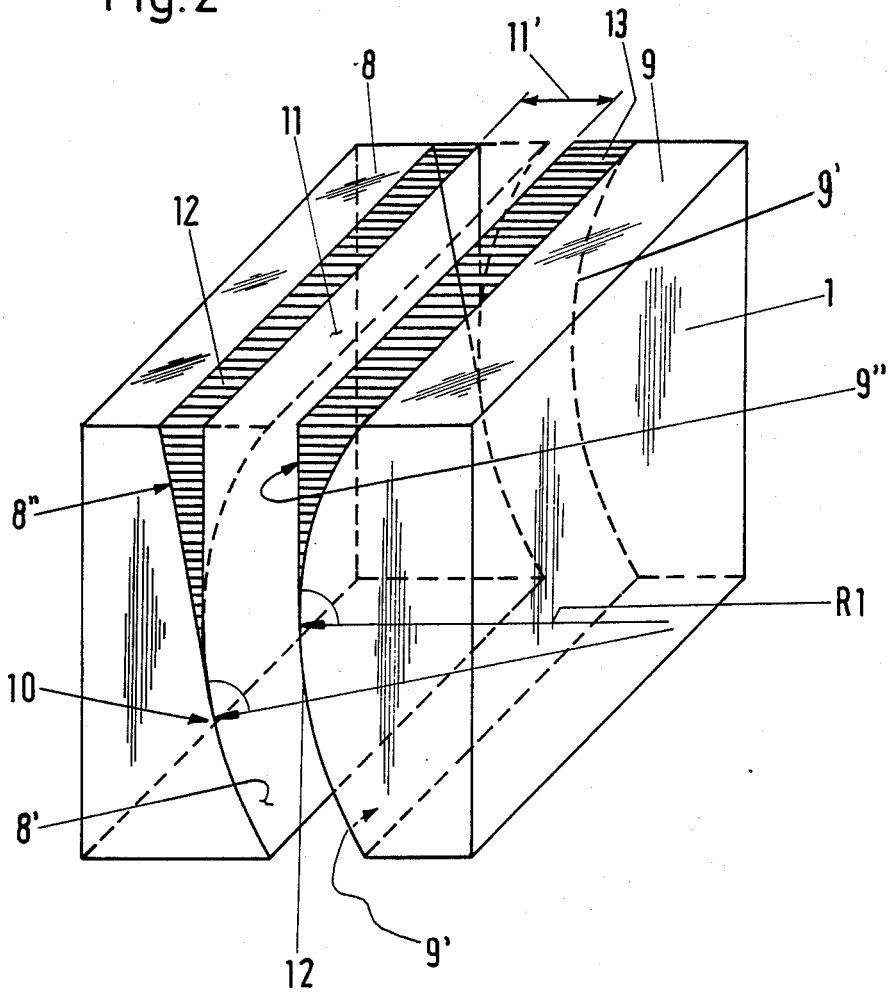
FIG. 2 is a perspective view of a mold constructed in accordance with the invention and on an enlarged scale as far as FIG. 1 is concerned.
Figure 3:
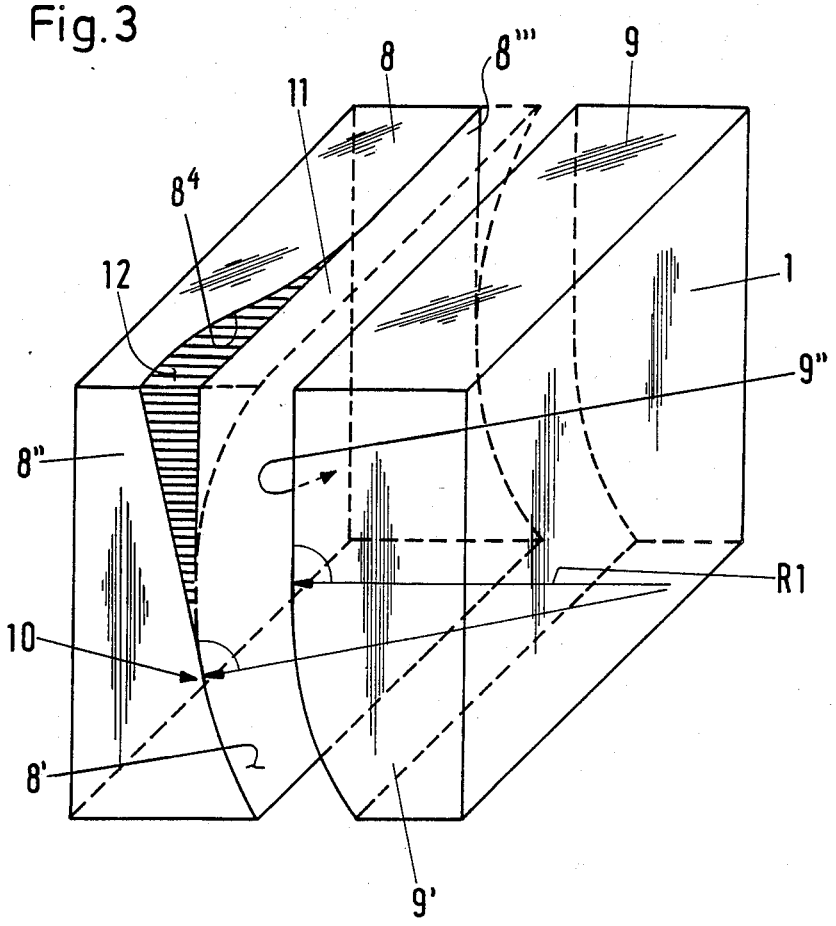
FIGS. 3 and 4 are perspective views of still further embodiments of the invention, which could be deemed to be developed out to FIG. 2.

FIG. 3 illustrates a modification of the mold from FIG. 2 which can be summarized as follows. The front section plane as illustrated runs through the middle of the wide portion of the mold so that only the rear portion or rear half is visible in FIG. 3. The outer wall 8 near the end is of a straight-up configuration with a wall surface 8''', while towards the middle, which is the area and zone closest to the observer of FIG. 3, the wall cavity is enlarged and modified to obtain the additional mold space 12' as far as the width extension of the mold is concerned. This, then, is a smaller but still for many cases adequate, space into which the casting spout can be inserted. As far as the inside (convex) wall surface is concerned, this surface 9' may continue (9') just as was shown in FIG. 2 or 9' may continue adding the space 13 just as before.

In the case of a slab ingot thickness in the upper portion of the range stated above, it may suffice to place the transition from a curved mold portion to a straight one directly into the plane of the horizontal so that the straight wall portion 9'' then runs up vertically as illustrated in FIG. 3. However, FIG. 3 can also be understood in the following manner: 8''' is the surface that is defined by a particular plurality of tangent lines which extend straight up from the line in which the horizontal plane of R1 intersects the curved surface 8'. 8'' is that surface portion which is defined by tangent lines that originate from surface 8' but in points 10 below that horizontal R1-containing plane. The surface $8^4$ is a transition defined by tangent lines originating above level 10, but below the horizontal level $R^1$.

Figure 4:
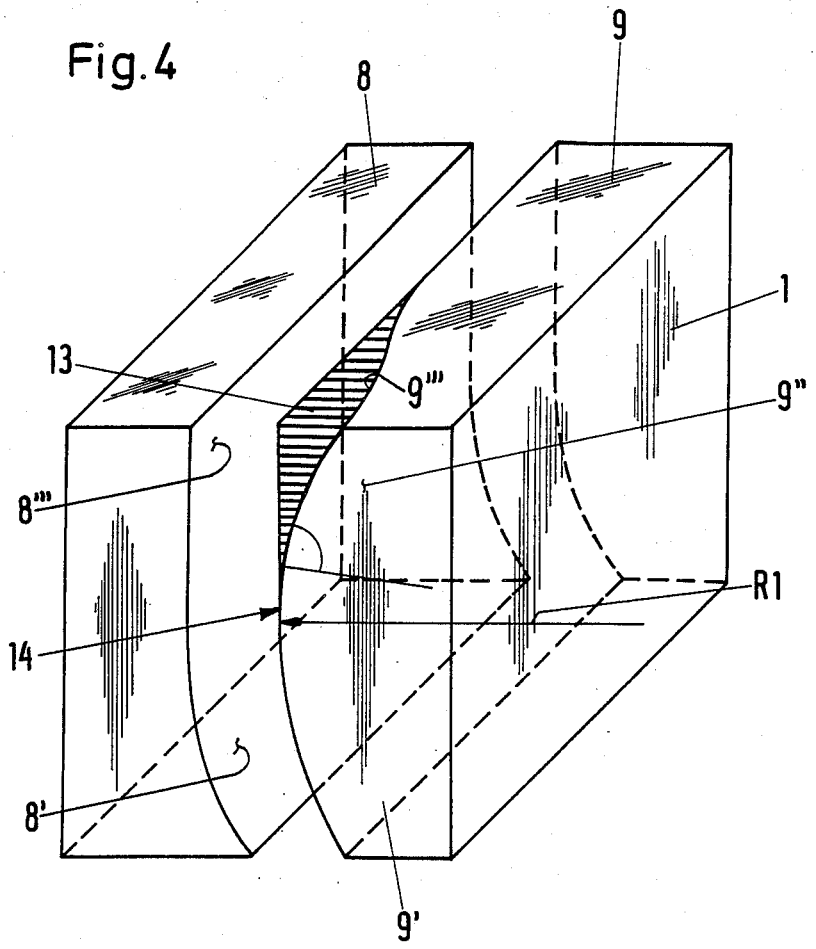

FIG. 4 illustrates a further modification which may be called a companion or analogous modification as compared with FIG. 3. Again, only the central part of the mold is of interest, and here the outer wall section is straight up (8''') all the way through. In the inner part of the mold, the curved wall portion 9''' has a complex contour, the inner portion establishes a widening which is identified by the hatching. The tangential transition point 10 from curved (9') to straight wall surface portion 9'' is situated above the horizontal plane defined by R1. However, near the outer end of the mold, wall 9 has surface portions defined by tangents which extend straight up from the R1-containing plane.

The advantage of the invention mold is to be seen in that, surprisingly, the skin is deformed very little inside the mold. There is a lower density in the deformation while the entire configuration is such that the space made available for the casting and charge spout and pipe is optimized. The entire arrangement is of relatively low vertical dimension. The water supply does not require any essential change so that the cooling conditions are really invariant. It can be seen that, in particular, the outer wall surface portions of the mold are not varied and are not different from known structures, so that the mold itself is not modified as far as the cooling conditions are concerned. The geometry of the mold is very favorable as far as controlling the positioning, guiding, and removing of the casting strand during the casting process. This, then, is an important feature for purposes of avoiding perforations.

The invention is not limited to the embodiments described above, but all changes and modifications thereof not constituting departures from the spirit and scope of the invention are intended to be included.

We claim:

1. In a mold for continuous casting in a vertical direction and having a plurality of walls, including two walls defining respectively the two long or wide sides of a slab ingot to be cast, the two corresponding walls respectively having inwardly oriented and facing wall surfaces, one of said surfaces being convex, the other one concave, the inprovement comprising respectively lower surface portions of the two wall surfaces being concentrically curved, at least one of said lower surface portions merging into an upper surface portion along a tangent that extends upwardly and outwardly vis-a-vis the interior of the mold.

2. The improvement as in claim 1 wherein a transition from the curved lower surface portion to a straight wall portion of the concavely curved wall surface is below a horizontal plane intersecting that curved lower surface portion at right angles.

3. The improvement as in claim 1, wherein a transition from the curved lower surface portion to a straight wall portion is above a horizontal plane that runs at right angles to a tangent on that lower surface portion.

4. The improvement as in claim 2, wherein said convex wall surface continues upward beyond a horizontal plane which intersects the convex surface at right angles.

5. In a mold for continuous casting having a plurality of walls, including two side walls defining the long or wide side of a slab ingot to be cast, these two side walls respectively having inwardly oriented and mutually facing wall surfaces, one being convex, the other one concave, the improvement comprising, respective lower wall surface portions of the two wall surfaces being concentrically curved, said lower wall surface portion of said concave surface merging into an upper surface portion along tangents extending straight upward, others extending upward and outward.

6. In a mold for continuous casting having a plurality of walls, including two side walls defining the long or wide side of a slab ingot to be cast, these two side walls respectively having inwardly oriented and mutually facing wall surfaces, one being convex, the other concave, the improvement comprising respective lower wall surface portions of the two wall surfaces being concentrically curved, said lower wall surface portion of said convex surface merging into an upper surface portion along tangents, some of the tangents extending straight up, others extending upward and outward.

* * * * *